United States Patent [19]

Juillard

[11] 4,054,159

[45] Oct. 18, 1977

[54] PICKING METHOD FOR A SHUTTLELESS WEAVING MACHINE

[75] Inventor: Yves Juillard, Mulhouse, France

[73] Assignee: Societe Alsacienne de Constructions Mecaniques de Mulhouse, France

[21] Appl. No.: 637,180

[22] Filed: Dec. 3, 1975

Related U.S. Application Data

[63] Continuation-in-part of Ser. No. 509,965, Sept. 27, 1974, abandoned.

[30] Foreign Application Priority Data

Oct. 4, 1973 France ..... 73.35451

[51] Int. Cl.[2] ..... D03D 47/34

[52] U.S. Cl. ..... 139/450; 139/446

[58] Field of Search ..... 139/122 R, 122 H, 122 S, 139/123, 124 R, 124 A, 125, 126, 127 R, 127 P, 194, 450, 445, 446, 447, 79

[56] References Cited

U.S. PATENT DOCUMENTS

| | | | |
|---|---|---|---|
| 2,072,161 | 3/1937 | Dewas | 139/448 |
| 2,116,620 | 5/1938 | Dewas | 139/448 |
| 2,580,994 | 1/1952 | Budzyna et al. | 139/79 |
| 2,960,118 | 11/1960 | Ancet et al. | 139/123 |
| 3,378,040 | 4/1968 | Moessinger | 139/122 H |
| 3,638,686 | 2/1972 | Sole et al. | 139/127 R |
| 3,678,967 | 7/1972 | Burhwiler et al. | 139/122 R |

*Primary Examiner*—Henry S. Jaudon
*Attorney, Agent, or Firm*—Holman & Stern

[57] ABSTRACT

A method and means for inserting the weft threads in a shuttleless weaving machine which are particularly advantageous. A weft thread reserve is formed between a selvedge of the fabric and the path of an inserting carrier, the weft thread is cut near the selvedge and pulled by the inserting carrier to the middle of the shed in the form of a loop having one arm constituted by the free end portion of the weft thread reserve and the other arm by the portion of weft thread connected to an outside weft, supply package, the apex of the thread loop in the inserting carrier is clamped by the nipper of a withdrawing carrier and pulled towards the other selvedge, the nipper of the withdrawing carrier opens when the same reaches a position distant from the other selvedge by an amount substantially equal to the length of the weft thread reserve, and the thread reserve is allowed to slide in the then open nipper of the withdrawing carrier so as to completely straighten as far as the other selvedge during the completion of the travel of the withdrawing carrier.

1 Claim, 17 Drawing Figures

PICKING METHOD FOR A SHUTTLELESS WEAVING MACHINE

RELATED APPLICATION

This application is a continuation-in-part of my co-pending application Ser. No. 509,965 filed Sept. 27, 1974 , now abandoned and entitled "PICKING METHOD FOR WEAVING MACHINES HAVING TWO COOPERATING CARRIERS."

BACKGROUND OF THE INVENTION

This invention relates to picking in shuttleless weaving machines having an outside weft supply package and two co-operating inserting and withdrawing carriers.

In such machines, the inserting carrier is used to pull the weft thread from the outside package to the centre of the shed, where the thread is taken over by the withdrawing carrier and stretched over the whole width of the shed.

PRIOR ART

In one known method, known as the Gabler method, the weft thread is brought as far as the middle of the shed in the form of a large loop, whereafter the loop arm connected to the first selvedge i.e., the selvedge disposed on the same side of the machine as the weft package — is cut, whereafter the cut and now floating piece of weft thread straightens completely by sliding in the nipper of the withdrawing carrier as far as the other selvedge.

In this method, the exchange of weft thread between the two carriers is reliable since the carriers are not provided with nippers, the weft thread which is being picked simply sliding permanently in the form of a loop on the carrier ends. The method also permits early crossing of the warp threads since the weft thread is stopped over substantially its whole length at the time the shed is being closed, so that valuable time is saved for beating up the weft thread. Unfortunately, the method has disadvantages; during the first half of the picking step the linear speed of the sliding thread is twice the speed of the inserting carrier, so that the complication of using weft supply unwinders becomes necessary. Also, some weft threads, such as fancy wefts and low resistance threads, cannot be exchanged in loop form. The method also entails complicated weft patterning and very careful control of the weft.

In another known method known as the Dewas method, the weft thread just inserted is cut on the first selvedge between the beating-up time and the time when its end is about to be picked up by a nipper of the inserting carrier, whereafter the weft thread is pulled to the centre of the shed width and taken up by a nipper of the withdrawing carrier and pulled as far as the second selvedge. In this method the weft thread is pulled always at the same speed as the carrier speed-i.e., relatively speaking, much more slowly than in the Gabler method — so that a wide variety of weft yarns, even those having a low resistance, can be used. Also, the cycle is simple, makes for ready adaptation of weft patterning and ensures easy control of weft unwinding.

Unfortunately, it also has disadvantages; the warp yarns cannot be crossed before the carriers have left the shed completely, so that valuable time is wasted in the case of beating up with the shed closed. If beating-up is achieved when the shed is not close enough, in the case of some articles which are very dense in the warp, the warp threads uncross unsatisfactorily at beating up to give the fault known as "hopping" or "skipping;" to overcome this the carriers have to leave the shed prematurely and so speed is lost for given stresses.

OBJECT AND SUMMARY OF THE INVENTION

It is an object of the invention to provide a method combining all the advantages of the two earlier methods just referred to but to retain as few of their disadvantages as possible.

To this end, according to the invention:

A weft thread reserve is formed between the first fabric selvedge and the path of the inserting carrier;

the weft thread is cut between the first selvedge and the thread reserve;

the weft thread is clamped in and pulled by the nipper of the inserting carrier as far as the middle of the shed in the form of a loop having one arm formed by the free thread end portion of the reserve and the other arm formed by the thread part connected to the outside package;

the thread loop in the inserting carrier is engaged and clamped by the nipper of the withdrawing carrier and is pulled towards the second selvedge;

the nipper of the withdrawing carrier opens when the same reaches a position distant from the second selvedge by an amount substantially equal to the length of the weft thread reserve, with simultaneous closure of the shed;

and the free thread reserve is allowed to slide in the open nipper of the withdrawing carrier so as to completely straighten as far as the second selvedge during the completion of the travel of the withdrawing carrier.

This method provides all the advantages of the Dewas method, namely slow weft unwinding, from the supply package, the ability to use a wide variety of weft threads, a simple cycle and simple weft mixers and ready control of weft supply, yet the method retains the advantage inherent in the Gabler method of early crossing of the warp threads. Of course, the invention obviates the disadvantage of the Dewas method of being unable to cross the warp threads on a moving weft thread until right at the very end of picking, before the carriers have completely left the shed.

Consequently, in the method of the invention, the warp threads can be crossed earlier in the cycle, as in the Gabler method, and for a given warp thread crossing rate the warp thread shed can be substantially fully opened for the beating-up period, thus ensuring satisfactory uncrossing of the warp threads in beating up as is essential to obviate the hopping or skipping previously referred to.

The method according to the invention also obviates the disadvantages of the Gabler method, namely rapid weft supply and the need for weft suppliers, and the complications of weft mixers and weft thread control.

The length of the weft thread reserve may be adjusted at will according to the features of the fabric to be obtained, i.e., depending on the desired angle of the shed at the time of beating-up the weft thread. Thus, a relatively large angle is required in weaving heavy fabrics with difficult uncrossing of the warp threads, while a relatively small angle is desirable in weaving light articles.

The invention will be better understood from the following description and from the accompanying drawings wherein:

DETAILED OF A PREFERRED EMBODIMENT

Figure 1:
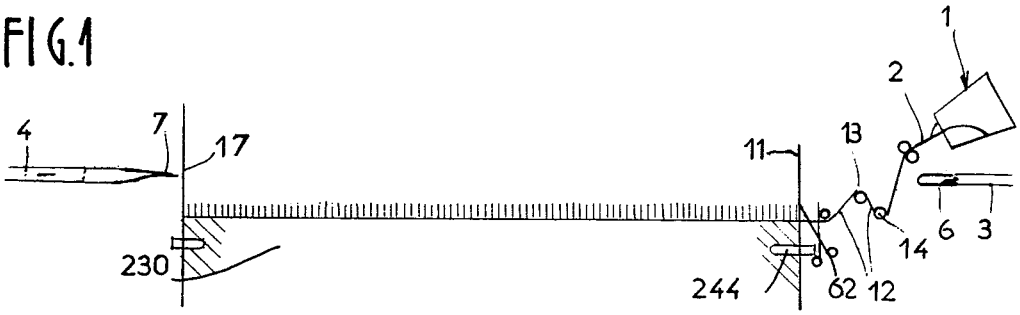
FIGS. 1 to 4 are diagrammatic plan views showing consecutive picking phases of the method according to the invention.

The method according to the invention for picking in a shuttleless weaving machine having an outside weft supply package 1 (FIG. 1) and two co-operating carriers, namely: an inserting carrier 3 and a withdrawing carrier 4 having a respective nipper 6, 7, derives from the Dewas method previously referred to, but instead of the previously introduced weft thread being cut flush with selvedge 11, of fabric 230, a weft thread reserve 12 is contrived deliberately, for instance, through the agency of a device which comprises two deflecting rollers 13, 14 and which will be described further on. The weft yarn reserve is preferably at least approximately 80 mm long.

Figure 2:
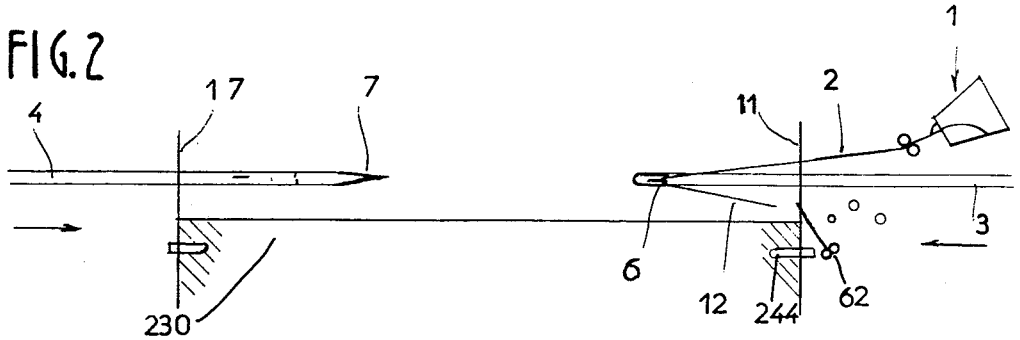
Figure 3:
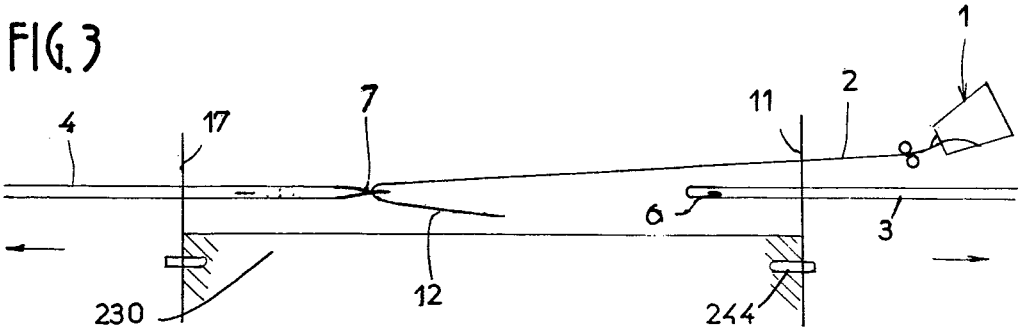

The nipper 6 of the inserting carrier 3 engages the weft thread 2 in the part which is between the thread reserve 12 and the package 1 (FIG. 2) and brings the thread to the centre of the shed in the form of a loop whose apex is held in the nipper 6 and one arm of which is embodied by the thread reserve 12 and the other by the thread part connected to the package 1. The thread is exchanged between the inserting and the withdrawing carrier at the centre of the shed-i.e., nipper 7 engages with the apex of the thread loop in nipper 6 and starts to pull the weft thread towards the second selvedge 17 of the fabric 230 (FIG. 3).

When nipper 7 is still distant from the second selvedge 17 (FIG. 4) by an amount *d* substantially equal to the length of the weft thread reserve 12, nipper 7 opens so that the free end of the weft thread unwinds by sliding in the nipper 7 during the entire final phase of the travel of withdrawing carrier 4 as far as the second selvedge 17.

Figure 4:
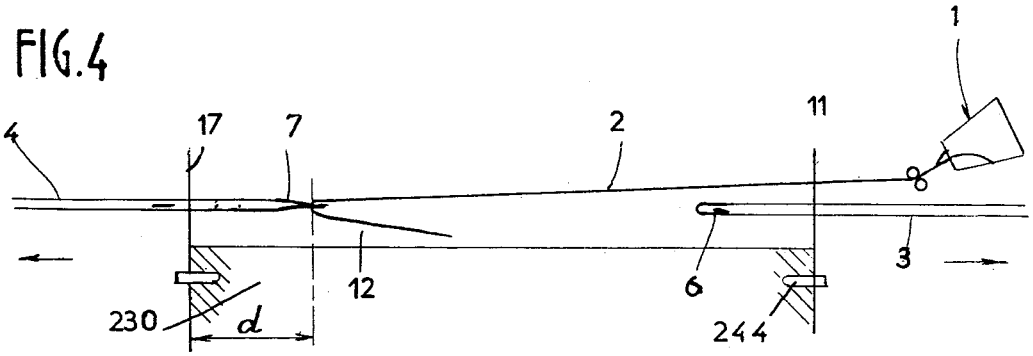

From the time corresponding to the position shown in FIG. 4, the major part of the weft thread 2 has ceased to move, and so the shed of warp yarns can be crossed very quickly.

Now, description will be made of a weaving machine adapted to carry out the method herein above described.

Figure 5:
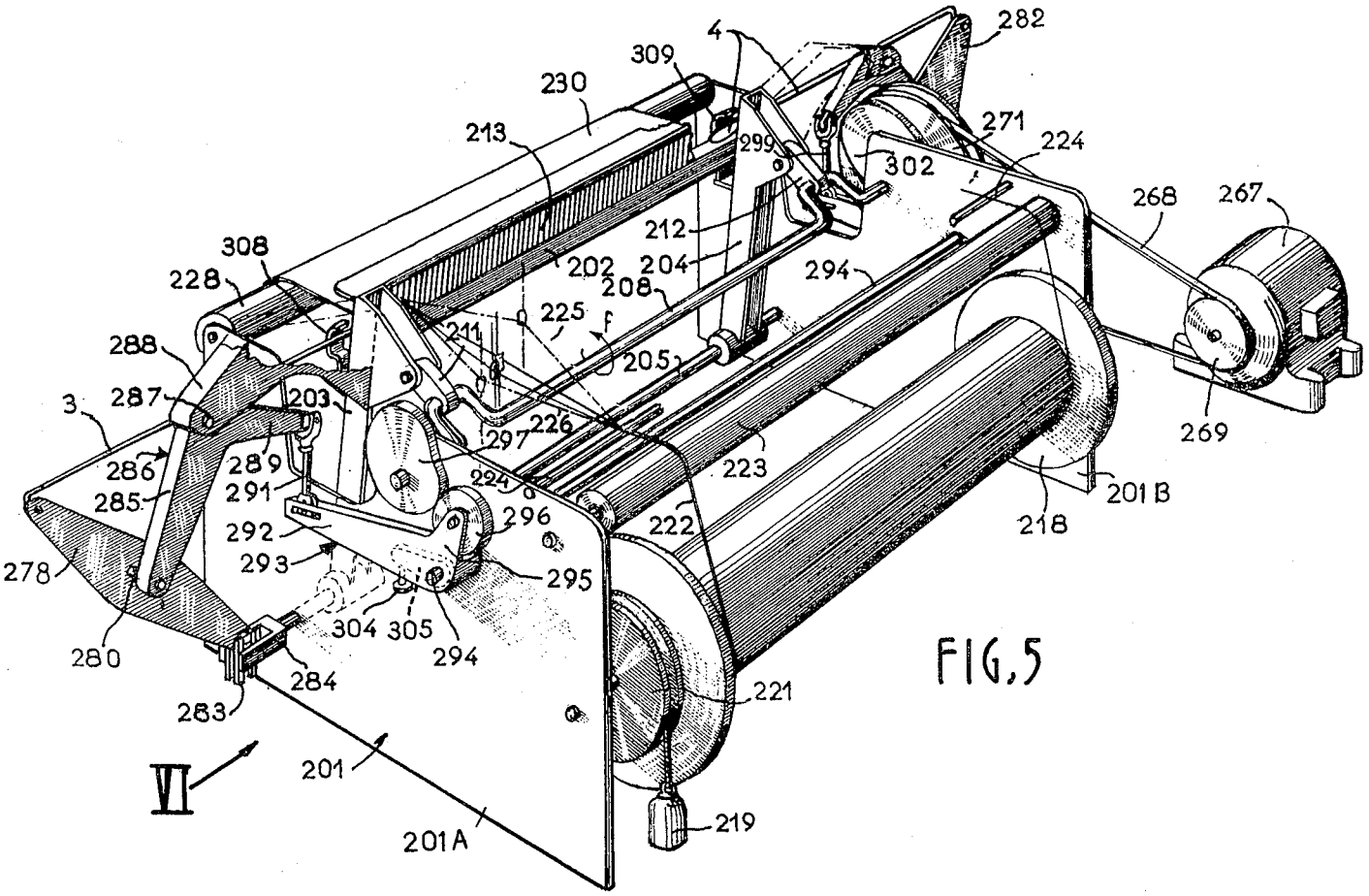
FIG. 5 is a perspective view of an improved weaving machine for carrying out the method of the invention.
Figure 6:
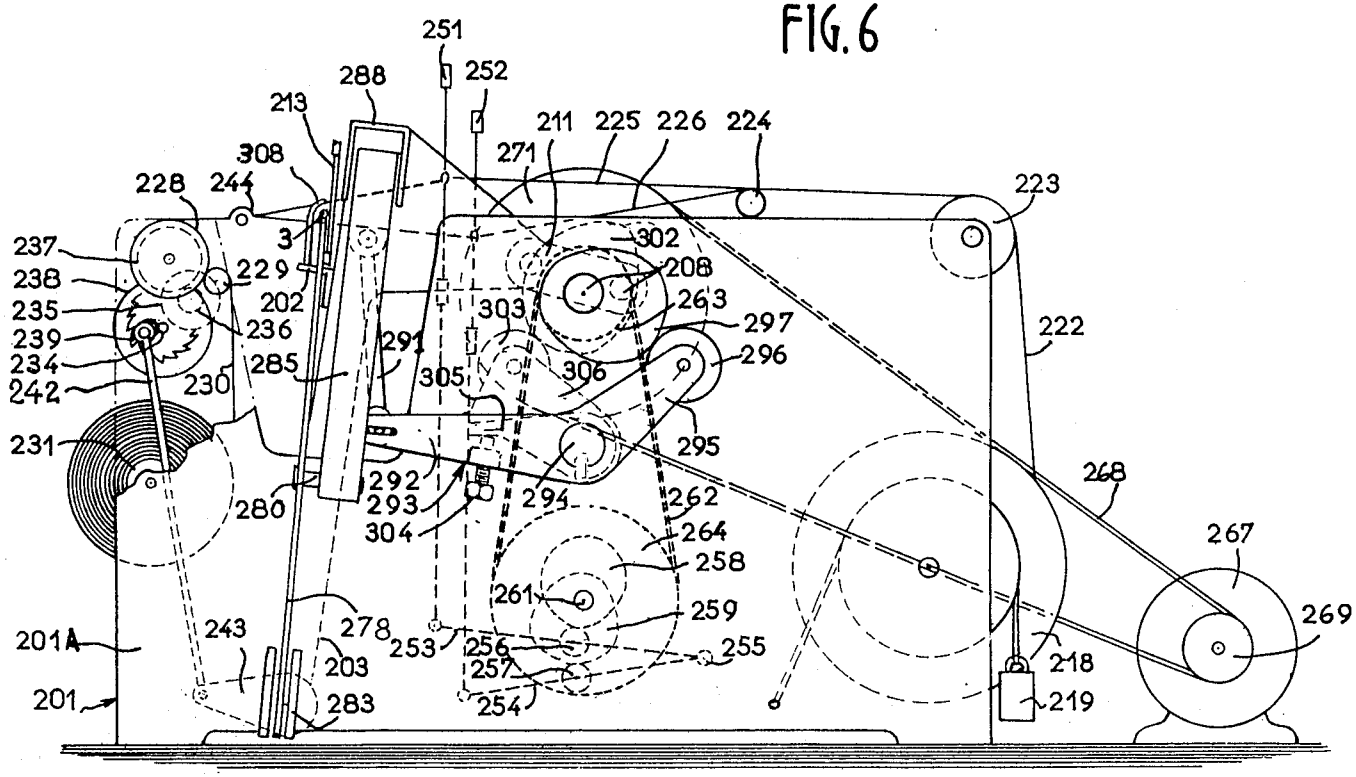
FIG. 6 is a side view as observed in the direction of the arrow VI of FIG. 5.

Referring now to FIGS. 5 and 6, the loom shown comprises a frame 201 with a pair of transversely spaced parallel vertical frame side members 201A, 201B suitably interconnected to provide a rigid structure. A sley 202 is mounted for reciprocation between the frame side members by means of two spaced swords 203 and 204 secured on a common transverse rocker shaft 205 journalled across the frame side members near the base of the frame. The sley 202 is reciprocated from a crankshaft 208 journalled in the frame side members near the top of the frame and having its spaced crank portions connected through pivoted links 211 and 212 to the tops of the respective swords 203 and 204. A conventional reed 213 is secured in upstanding relation from the front side of the sley 202 and the warp threads 225, 226 are passed through the spaces between the teeth of the reed in the usual way. A pair of weft thread carriers 3 and 4 are supported for reciprocation towards and away from each other across the width of the frame adjacent the sley for insertion of the weft threads through the shed of warp threads, carrier 3 being an inserting carrier and carrier 4 being a withdrawing carrier.

Journalled across the rear part of the frame 201 is a warp beam or roller 218 provided with any suitable regulating means here shown as a weight 219 suspended from a rope trained over a pulley 221 secured to one end of the warp beam. Wound around the warp beam 218 in the conventional manner are a multiplicity of warp threads only two of which are indicated at 222. The warp threads 222 extending from the warp beam 218 are passed over a main warp-carrier roller 223 followed by an auxiliary warp carrier roller 224 of smaller diameter, beyond which the alternate warp threads are separated into an upper sheet 225 and a lower sheet 226 which in the usual manner are passed through the eyes of respective sets of heddles 251 and 252 which are reciprocated in opposite senses so as to interchange cyclically the relative positions of said upper and lower sheets of warp threads every time a pick of weft thread has been passed by means of the carriers 3 and 4 through the space, or shed, defined between said sheets, thereby to weave the fabric 230.

The woven fabric is passed over a winding roll 228 and between the latter and an adjacent backing roll 229, and is taken up by means of the cloth beam or roller 231 journalled at the front of the frame.

Conventional means are provided for driving the winding roll 228 and cloth beam 231 in step-by-step rotation and such means are shown in FIG. 6 as comprising a lever arm 243 secured to an end of the rocker shaft 205 and connected through a rod 242 to a pawl and ratchet system 238–239 so as to impart stepped rotation to the ratchet wheel 239. This in turn, through gearing 234–235–236–237, is shown as rotating the winding roll 228. A templet 244 (see also FIGS. 11 and 12) serves to maintain transverse tension in the woven fabric as it is passed toward the winding roll 228.

The heddle harness including the afore-mentioned heddles 251 and 252 is actuated through means diagrammatically shown as comprising a pair of levers 253 and 254 connected to the lower ends of the heddle harness and pivoted on a shaft 255 mounted across the lower part of the frame. The levers 253 and 254 carry follower rollers 256 and 257 adapted to be engaged by respective cams 258 and 259 mounted on a camshaft 261 journalled across the frame and rotated from the crankshaft 208 through a drive chain 262 trained at its lower end around a large sprocket wheel 264 secured on shaft 261 and at its upper end around a smaller sprocket 263 secured on crankshaft 208.

The crankshaft 208 from which the various main components of the loom are operated may in turn derive its rotation from an electric motor 267 through a drive belt 268 trained over a motor pulley 269 and around a large radius pulley 271 secured to the crankshaft and serving as a regulator flywheel.

The heddles 251 and 252 are oppositely reciprocated up and down to reverse cyclically the direction of the shed, i.e., cyclically to interchange the relative positions between the upper sheet 225 of warp threads and the lower sheet 226 thereof, the weft thread carriers 3 and 4 are both caused to move inwards toward each other into the shed until their inner ends meet substantially midway of the width of the shed and then away from each other and out of the shed. During the inward stroke the inserting carrier 3 is carrying an end portion of weft thread delivered hereto from a suitable supply package 1, and as the inner ends of both carriers meet midway of the shed this thread is transferred from carrier 3 to the other carrier 4, so that at the outward stroke of both carriers the carrier 4 draws the weft thread completely through the shed to the opposite end thereof, thus cooperating with the carrier 3 to complete a weft-shooting operation. The inner ends or heads 274, 275 of both carriers are made to rest simply upon the warp threads supported on the upper surface of the sley 202 and are in engagement with the front face of reed 213 while their outer ends are swivelled to the free ends of respective levers 278 and 282 (FIG. 5) which are arranged to impart the requisite reciprocations to the carriers transversely of the frame while simultaneously allowing said carriers to follow the reciprocations of the sley and reed longitudinally of the frame. Lever 278 carries a pin at its lower end slidably mounted in a guideway 283 secured between and perpendicularly to the spaced arms of a horizontal clevis 284 secured to the projecting end of the rocker shaft 205. Lever 278 further carries midway of its length a pivot pin 280 to which is pivoted one arm 285 of a two-armed lever 286 having its apex pivoted by means of a pin 287 to a bracket 288 projecting from the sley 202. As will be especially apparent from FIG. 6, the midplane of slideway 283, the planes of levers 278 and 286 remain at all times parallel with the midplane of the swords 203, 204, while the axes of pivots 280 and 287 remain normal to said plane. Thus on reciprocation of the sley and rocker shaft 205, pivot 280 describes an arc of a circumference about the axis of pivot 287, the lower end of lever 278 describes a straight line path in the slideway 283, while the upper end of lever 278 and hence the outer end of carrier 3 connected thereto describes a straight-line path axially of the carrier. For imparting reciprocation to the carrier along this straight-line path, the free end of arm 289 of lever 286 is connected through a link 291 with one arm 292 of a two-armed lever 293 having an intermediate point of it secured on a projecting end of a shaft 294 journalled in the frame side members 201. The other arm 295 of two-armed lever 293 carries a follower roller 296 engaging a cam 297 secured on the related projecting end of crakshaft 208. Thus, on rotation of the crankshaft, cam 297 imparts a controlled pivotal reciprocation to lever 293 and through link 291 to lever 286 which in turn reciprocates pivot 280 over the part-circular path of motion previously mentioned and imparts to the carrier 3 the desired reciprocation over its straight line path, independently of the bodily rotary reciprocation of lever 278 and carrier 3 concurrently with the sley. The other carrier 215 is operated by similar mechanism including a further cam 302 (FIG. 6) mounted on the opposite end of the crankshaft 208 engaging a follower roller 303 carried on a lever 306 connected by a link 299 (FIG. 5) to a two-armed lever corresponding to lever 286 connected in turn to the opposite carrier-reciprocating lever 282 corresponding to lever 278.

Figure 7:
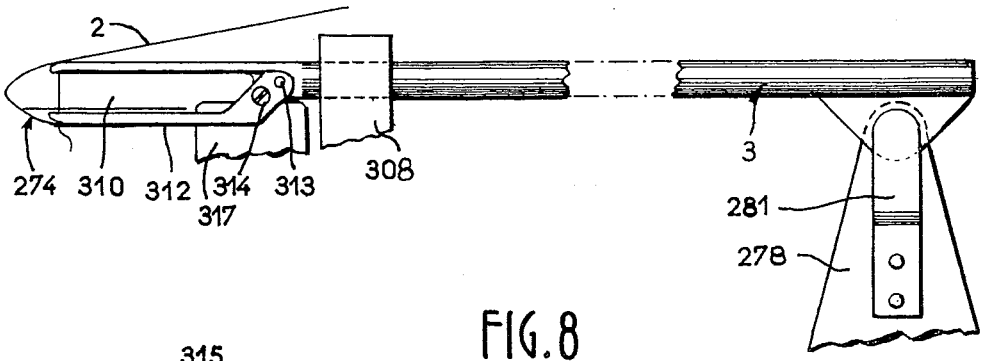
FIG. 7 is a large-scale front view of the weft inserting carrier of the weaving machine of FIGS. 5 and 6.
Figure 8:
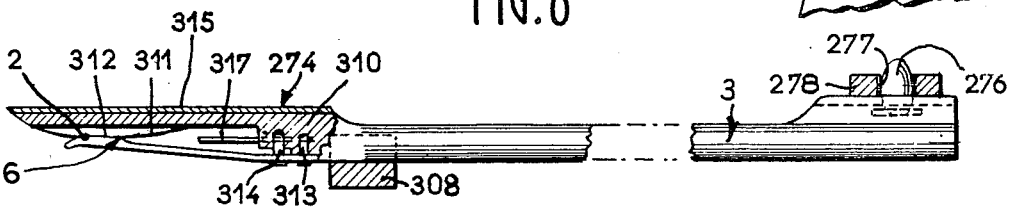
FIG. 8 is a corresponding plan view with parts broken away.

Referring to FIGS. 7, and 8, the head portion 274 of the inserting carrier 3 includes a main portion 310 which is in the form of a channel with a vertical web and horizontal flanges. The lower flange of the channel is formed with a pair of cooperating clamp jaw portions 311 and 312 having convex surfaces directed toward each other to form the nipper 6 adapted to clamp a portion of the weft thread between them. Clamp jaw 311 is substantially rigid while jaw 312 is resiliently flexible being in the form of a resilient strip secured to the channel portion 310 by means of a screw 314 and located in position by a locator pin 313 cooperating with a socket in the channel. A vertical separator strip 317 upstanding from the upper surface of the sley as described further on with more detail, is provided for causing the clamp members 311, 312 to open out towards the end of the outward reciprocation stroke of the inserting carrier 214 so that beyond said strip 317 the clamp jaws 311, 312 close in again to grip the end portion of a further length of weft yarn to be presented thereto from the weft supply package 1 through a thread guide 105 carried by the sley 202.

Figure 9:
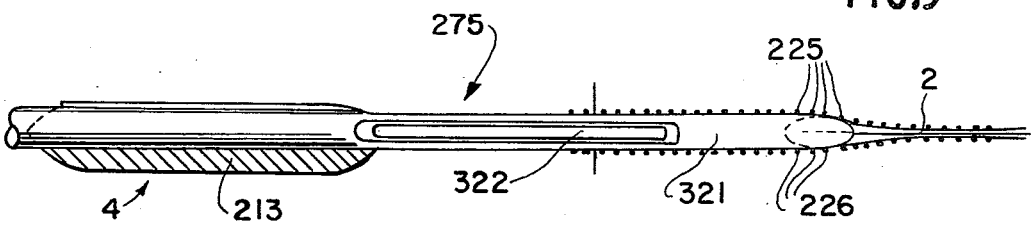
FIG. 9 is a front view of the withdrawing carrier.
Figure 10:
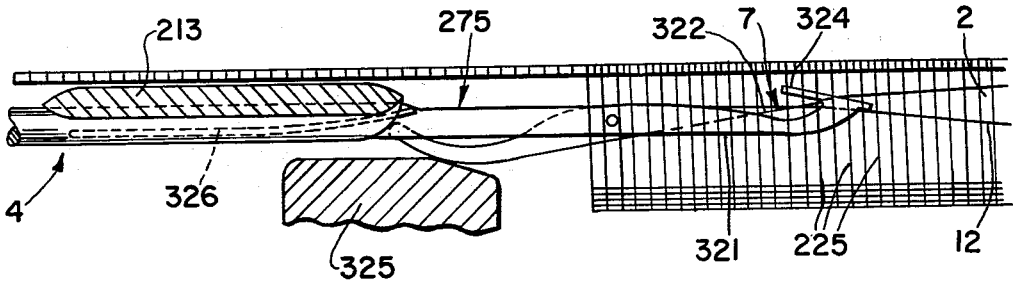
FIG. 10 is a corresponding plan view.

As to the cooperating withdrawing carrier 4, illustrated in FIGS. 9 and 10, its head portion 275 comprises a pair of jaws 321, 322 which together form the nipper 7. The jaw 322 is formed in a side of it with a hook portion 324 adapted, toward the innermost point of the inward reciprocatory stroke of the carrier, to engage the length of weft thread 2 presented by the inserting carrier 3 for effecting the transfer of the thread from carrier 3 to carrier 4.

The jaw 322 is resiliently urged against the hook portion 324 of jaw 321 by a spring 326 to hold the weft thread and it is moved away from said hook portion by a separator strip 325 (shown in FIG. 10 only) secured to the top surface of the sley and so positioned that the nipper formed by these jaws opens at the moment when it is still distant from the second selvedge 17 (FIG. 4) by an amount "d" substantially equal to the length of the weft thread reserve 12, near the end of its outward stroke.

Figure 11:
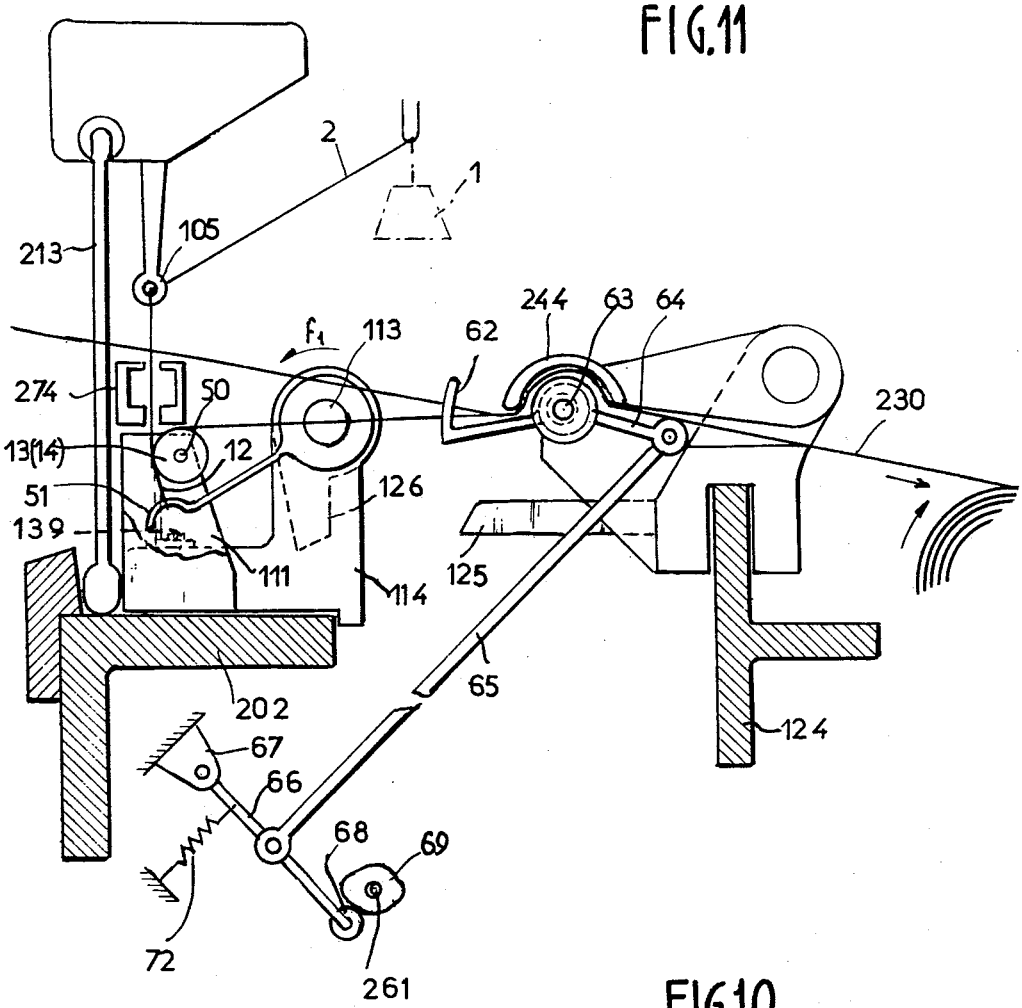
FIG. 11 is a side view of the weft thread reserve-forming device shown in section made on line XI—XI of FIG. 12.
Figure 12:
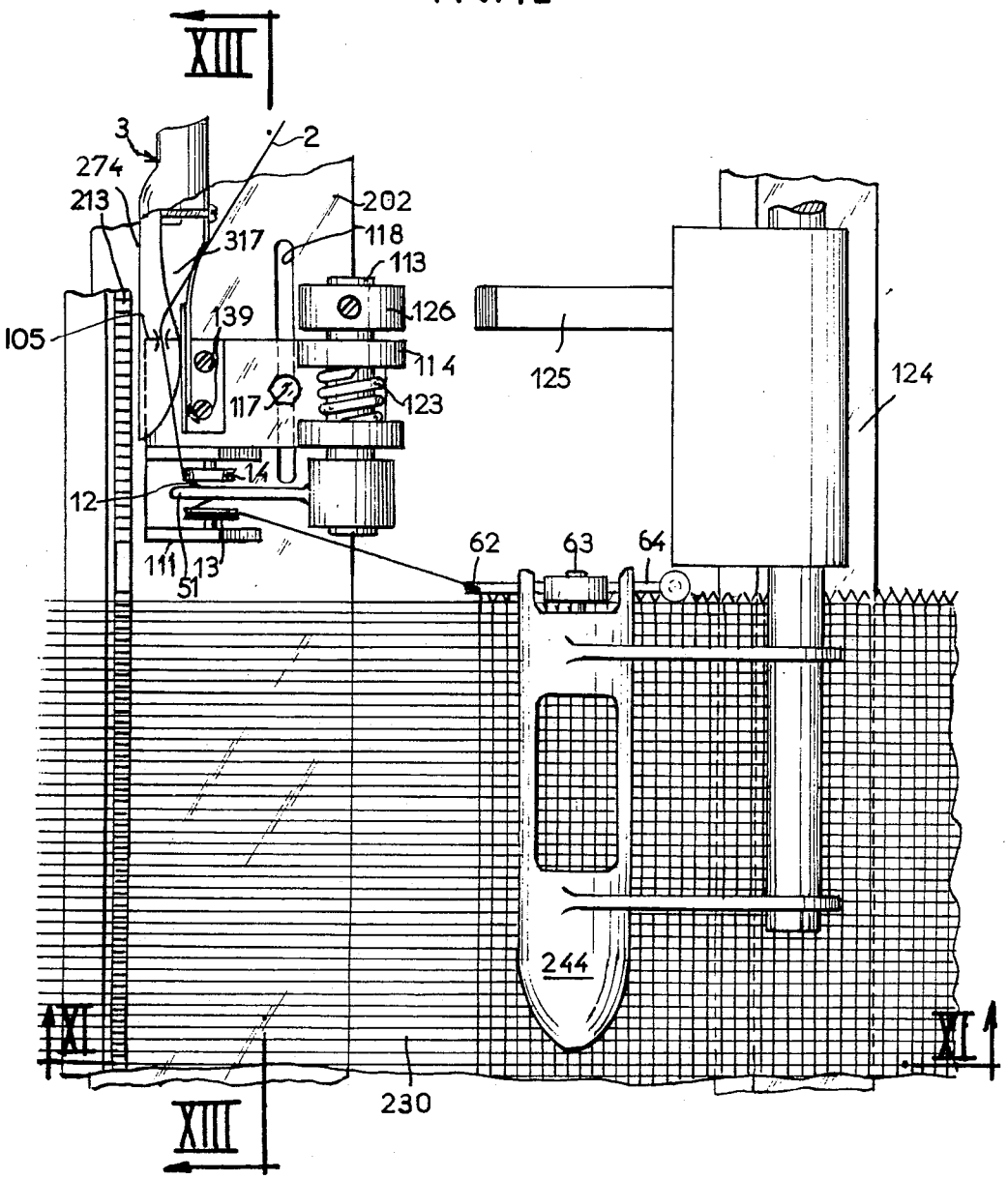
FIG. 12 is a corresponding top view.
Figure 13:
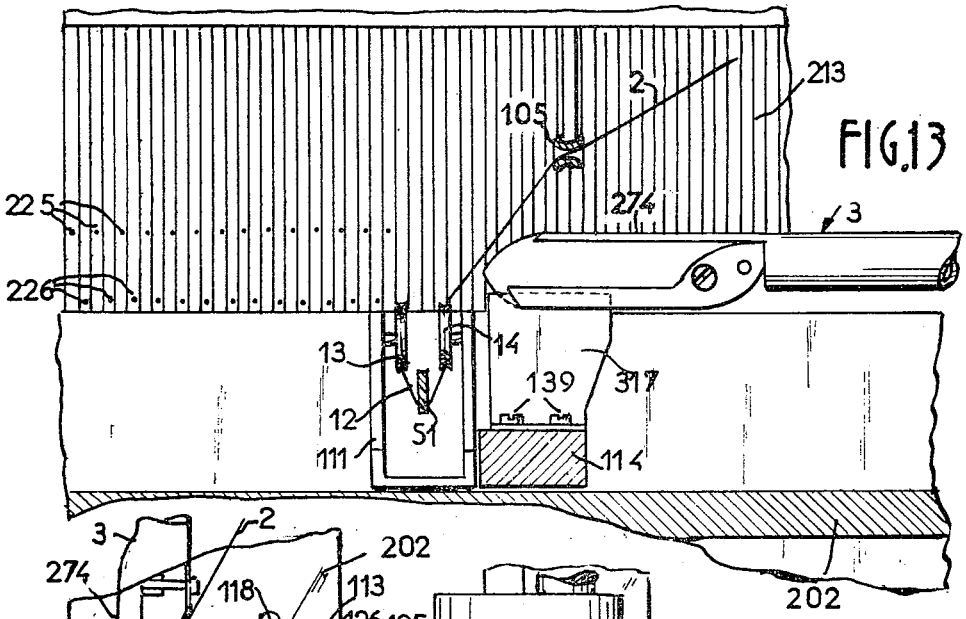
FIG. 13 is a longitudinal vertical section on line XIII—XIII of FIG. 12.

More specifically, as illustrated in FIGS. 11–13, the means forming the weft thread reserve include the deflecting rollers 13, 14 and hook 51. The deflecting rollers are mounted idly on a spindle 50 carried by a u-shaped support 111 attached to a bracket 114 which is adjustably secured to the upper surface of the sley 202 near one end of the latter by means of a bolt 117 engaged in a slot 118 formed in the sley.

Figure 14:
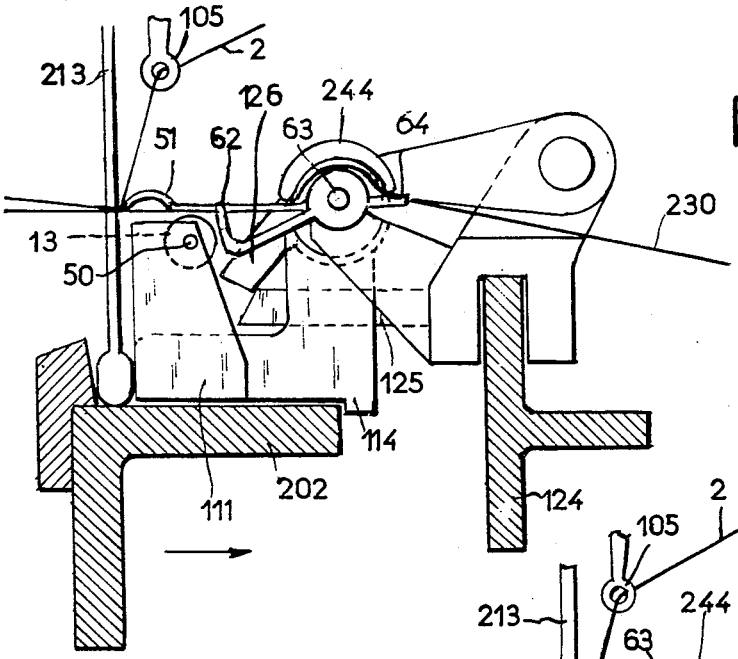
FIGS. 14 to 16 are similar to FIG. 11 and illustrate the relative positions of the parts at different points of the weaving cycle; the weft thread cutter not being shown in FIGS. 14 and 16 for the sake of clarity.

The hook 51 is adapted to move up and down between the two deflecting rollers 13, 14. It is secured to a shaft 113 mounted for pivotal movement in the bracket 114 and urged in the direction indicated by arrow *f* in FIG. 11 by a coil spring 123 (FIG. 12) which surrounds pivot 113 and has one of its ends anchored to the pivot and its other end anchored to bracket 114. The hook 51 can be rotated in the opposite or clockwise direction against the action of a spring 123 by a stationary camming abutment 125 projecting from the fixed frame structure 124 and positioned in general alignment longitudinally of the frame (i.e., parallel to the direction of the warp threads) with a camming finger 126 projecting from pivot 113 and secured to said pivot. It will be understood that in operation of the loom the sley 202 and reed 213 are reciprocated in the longitudinal direction for cyclically pressing the weft thread against the fell and as the sley and reed approach the end of the beating-up stroke toward the right as shown in FIGS. 11 and 12, the finger 126 engages abutment 125 (FIG. 14) so that the finger and with it the hook 51 are rotated clockwise to lift the hook. Thereafter the sley reverses its movement and as it starts receding (leftward in the figures) camming finger 126 disengages abutment 125 and allows the hook 51 to be rotated clockwise by spring 123 (aided by gravity) to the position illustrated in FIG. 11.

The separator strip 317 hereinabove referred to with reference to FIGS. 7 and 8 is secured to the bracket 114 by means of screws 139 (FIGS. 12 and 13).

A cutter 62 (FIGS. 11 and 12) for the weft thread is mounted for pivotal movement on a horizontal spindle 63 carried by the templet 244. Secured to the cutter is a lever 64 pivoted to the upper end of a connecting rod 65 the lower end of which is pivoted to a further lever 66 which is pivoted to a support 67 secured to the machine frame. The lever 66 carries a cam follower 68 engaged against a cam 69 secured to shaft 261 (FIG. 6). A spring 72 urges the lever 66 toward the cam 69.

The general operation of the loom is as follows:

Electric motor 267 continuously rotates the main crankshaft 208 in the direction indicated by arrow *f* in FIG. 5 and the crankshaft in turn imparts motion to the main components of the machine as described earlier. The sley 202 is thus rocked back and forth by the action of the links 211 and 212 connected to it and to the crankshaft. Camshaft 261 is rotated to impart out-of-phase vertical reciprocation through cams 258 and 259 to the heddles 251 and 252. Lever arm 243 is rocked by the rocker shaft 205 to impart step-by-step rotation to the cloth take-up device 235–239; and crankshaft 208 acting through cams 297 and 302 and the linkages described, imparts controlled reciprocation to the carriers 3 and 4 toward and away from each other concurrently with the bodily rocking reciprocation of said carriers together with the sley.

The setting of cams 297 and 302 on the crankshaft is such that the spacing between the carriers 3 and 4 reaches its maximum value at the time the sley 202 is at the forward end of its rocking stroke, while the carrier heads are nearmost to each other to perform the weft transfer action as the sley attains the rear end of its stroke.

Figure 15:
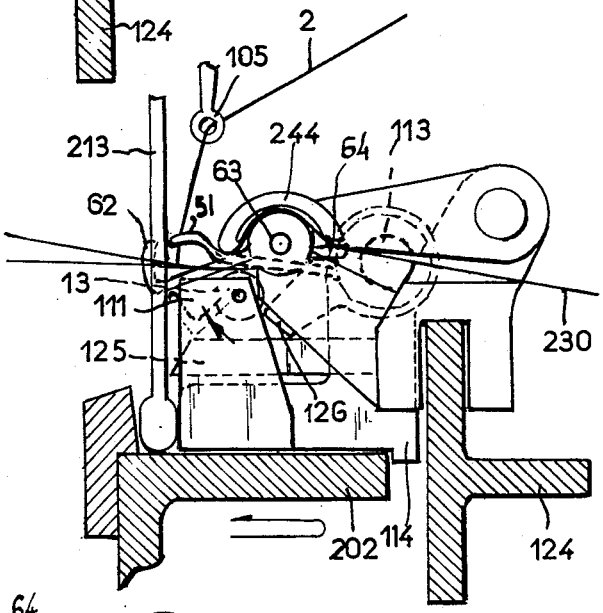

In FIG. 11, 12 and 13, the inserting carrier 3 is in a position ready for starting its travel mid-way into the shed. Weft yarn reserve 12 is formed about the two deflecting rollers 13, 14 and the hook 51. The portion of weft thread located between the thread guide 105 and the deflecting roller 14 is on the path of travel of the inserting carrier 3. Upon the nipper 6 of the inserting carrier 3 catching the thread, the cutter 62 is moved downwardly and cuts the weft thread. The cutter is raised only at the moment when the weft thread will be pressed against the fell of the cloth so that the weft thread is placed around the cutter (FIG. 15).

Figure 17:
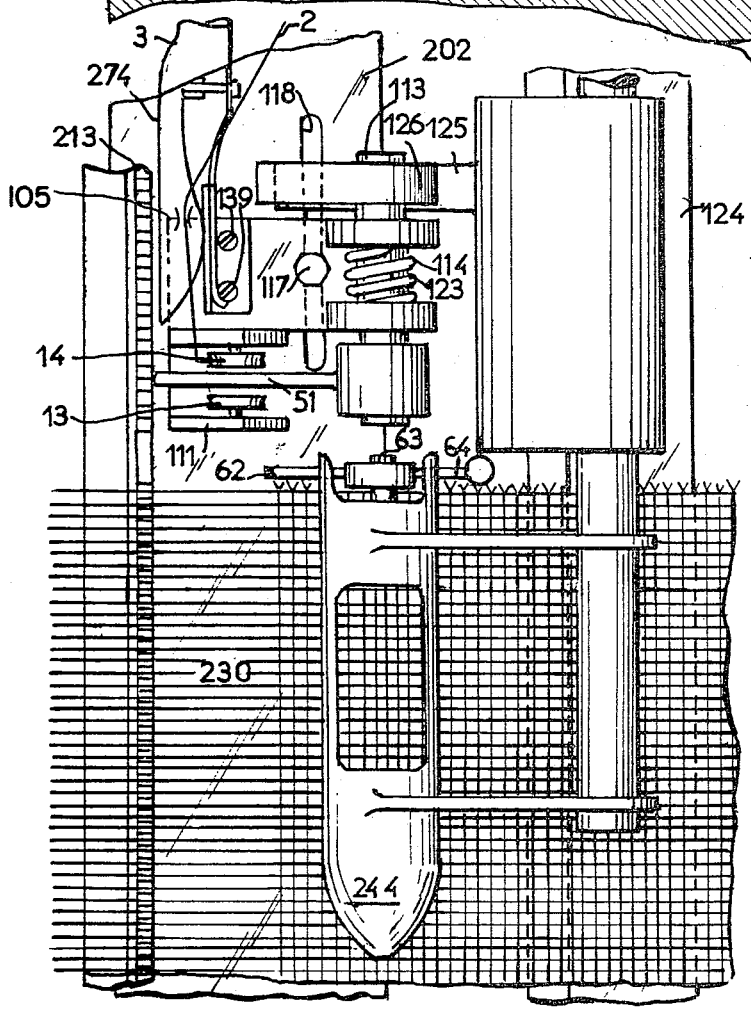
FIG. 17 is a plan view similar to FIG. 12, but with the parts being positioned at the same point in the cycle as in FIG. 16.
Figure 16:
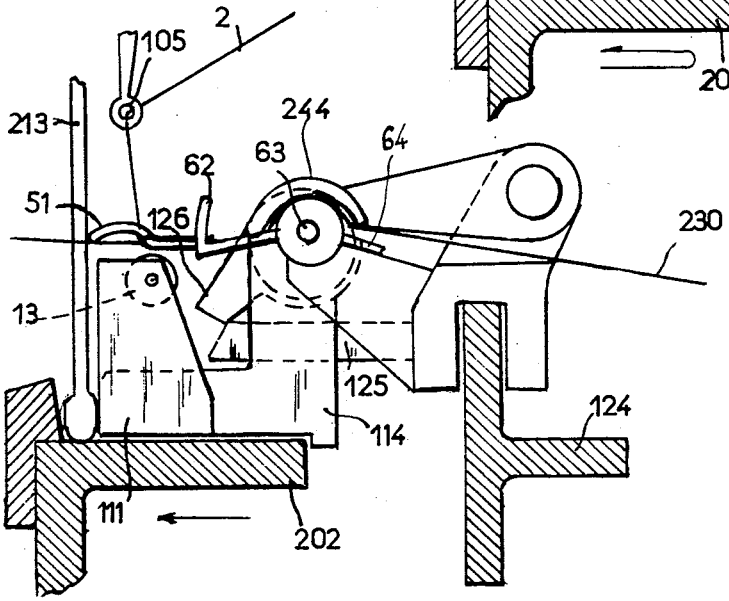

Upon the sley 54 reaching near the end of its forward stroke (FIG. 14), the hook 51 is raised in front of the weft thread located against comb 213. At the beating-up of the weft thread (FIG. 15), the cutter 62 is raised to enable the weft thread to pass around the cutter. In FIGS. 16 and 17, the sley 54 starts backwardly and the weft thread is held by the cloth while the hook 51 moves downwardly and carries along therewith the weft thread which is thus engaged on the deflecting rollers 13, 14 to form a new reserve.

The cycle is ready to start again as illustrated in FIGS. 11–13.

The invention is not to be confined to any strict conformity to the showings in the drawings but changes or modifications may be made therein so long as such changes or modifications mark no material departure from the spirit and scope of the appended claims.

What I claim is:

1. A shuttless weaving machine having a rocking sley, a shed-forming mechanism, an outside weft thread supply package and cooperating inserting and withdrawing weft thread carriers reciprocable on a predetermined rectilinear path on said sley, means for reciprocating said weft thread carriers, said carriers each having a nipper with the nipper of the inserting carrier being capable to pull mid-width into the shed a weft thread portion from a position between the outside weft thread supply package and the associated first selvedge of the fabric which is near one side of the machine, said nipper of said withdrawing carrier being capable to grip the weft thread from said inserting carrier and to pull same as far as a second selvedge of the fabric on the other side of the machine, means for forming a weft thread reserve between the first selvedge and said path of said inserting carrier, means for cutting the weft thread between said first selvedge and said weft thread reserve, means for actuating said weft thread cutting means in synchronism with the reciprocating movement of said rocking sley, said nipper of said inserting carrier being capable to clamp and pull said weft thread in the form of a loop as far as the middle of the shed, said loop having one arm formed by the free thread end of said weft thread reserve and the other arm formed by the thread part connected to said outside weft thread supply package, means for opening the nipper of said withdrawing carried upon said withdrawing carrier reaching a position distant from said second selvedge by an amount substantially equal to the length of said weft thread reserve, with simultaneous closure of the shed to provide for said weft thread loop to be removed by straightening the weft thread being pulled toward said second selvedge and allowed to slide in the open nipper of said withdrawing carrier so as to completely unwind as far as the second selvedge during the completion of the travel of said withdrawing carrier, said weft thread reserve forming means comprising two rollers and a hook; said rollers being idly mounted for rotation and spaced apart on two coaxial pivots carried by said sley immediately under the start portion of said rectilinear path of travel of said inserting carrier, said hook being reciprocable vertically in a plane extending between said two rollers from a position higher than said rollers to a position lower than said rollers, said machine further comprising means for actuating said hook in synchronism with the reciprocating movement of said rocking sley.

* * * * *